US005541822A

United States Patent [19]

Bamber

[11] Patent Number: 5,541,822

[45] Date of Patent: Jul. 30, 1996

[54] FLASHLIGHT WITH PIVOTING HEAD

[75] Inventor: David J. Bamber, Wichita, Kans.

[73] Assignee: The Coleman Company, Inc., Wichita, Kans.

[21] Appl. No.: 201,464

[22] Filed: Feb. 24, 1994

[51] Int. Cl.[6] ..... F21L 7/00

[52] U.S. Cl. ..... 362/190; 316/199; 316/419; 316/287; 316/427; 316/202

[58] Field of Search ..... 362/188, 197, 362/199, 285, 287, 428, 427, 200, 190, 191, 419, 418, 202, 203, 204; 248/289.1, 291

[56] References Cited

U.S. PATENT DOCUMENTS

| | | | |
|---|---|---|---|
| D. 113,400 | 2/1939 | Ritter . | |
| 699,546 | 3/1901 | Newgold | 144/209 R |
| 1,689,382 | 10/1928 | Eaton | 362/191 |
| 1,699,927 | 1/1929 | Stearns | 362/199 |
| 1,807,129 | 5/1931 | Nuckolls | 362/199 |
| 1,863,151 | 6/1932 | Barber | 362/191 |
| 1,899,868 | 2/1933 | Herlbauer | 362/199 |
| 2,040,423 | 5/1936 | Barber et al. | 362/191 X |
| 2,205,163 | 6/1940 | Blau | 362/199 |
| 2,539,974 | 1/1951 | Riddell | 362/199 |
| 4,196,821 | 4/1980 | Teti, Jr. et al. | 248/291 X |
| 4,432,042 | 2/1984 | Zeller | 362/199 X |
| 4,464,707 | 8/1984 | Forrest | 362/375 X |
| 4,466,664 | 8/1984 | Kondou | 362/291 X |
| 4,495,550 | 1/1985 | Visciano | 362/189 |
| 4,533,982 | 8/1985 | Kozar | 362/183 |
| 4,586,113 | 4/1986 | Tsuyama | 362/188 X |
| 4,706,331 | 11/1987 | Compton | 362/427 X |
| 4,739,457 | 4/1988 | Orr | 362/287 |
| 4,782,435 | 11/1988 | Manzoni | 362/427 |
| 4,937,713 | 6/1990 | Holt | 362/186 |
| 4,949,928 | 8/1990 | Hoshino | 248/291 X |
| 4,974,130 | 11/1990 | Friedman | 362/199 |
| 5,119,280 | 6/1992 | Yang | 362/200 X |
| 5,355,746 | 10/1994 | Lin | 362/72 X |
| 5,410,457 | 4/1995 | Parker | 362/197 X |

FOREIGN PATENT DOCUMENTS

| | | | |
|---|---|---|---|
| 327882 | 10/1920 | Germany | 362/190 |
| 522078 | 3/1931 | Germany | 362/399 |

*Primary Examiner*—Denise L. Gromada
*Assistant Examiner*—Thomas M. Sember

[57] ABSTRACT

A flashlight includes a body for holding a battery and a head which is pivotally mounted on the body. The body includes a pair of spaced-apart hinge portions, and a hinge portion of the head is positioned between the spaced-apart hinge portions and retained by a pivot pin. The head is pivotable between a first position in which the light beam from the head is parallel with the longutidnal axis of the body and a second position in which the light beam is perpendicular to the axis of the body. Detents on the pivot pin and on the head maintain the head in a selected position. A wire for maintaining electrical contact between a light in the head and the battery as the head pivots extends from the head through the pivot pin and into the body. A movable support clip on the body supports the body in a vertical position on a horizontal surface when the head is in the second position.

16 Claims, 3 Drawing Sheets

Fig. 1
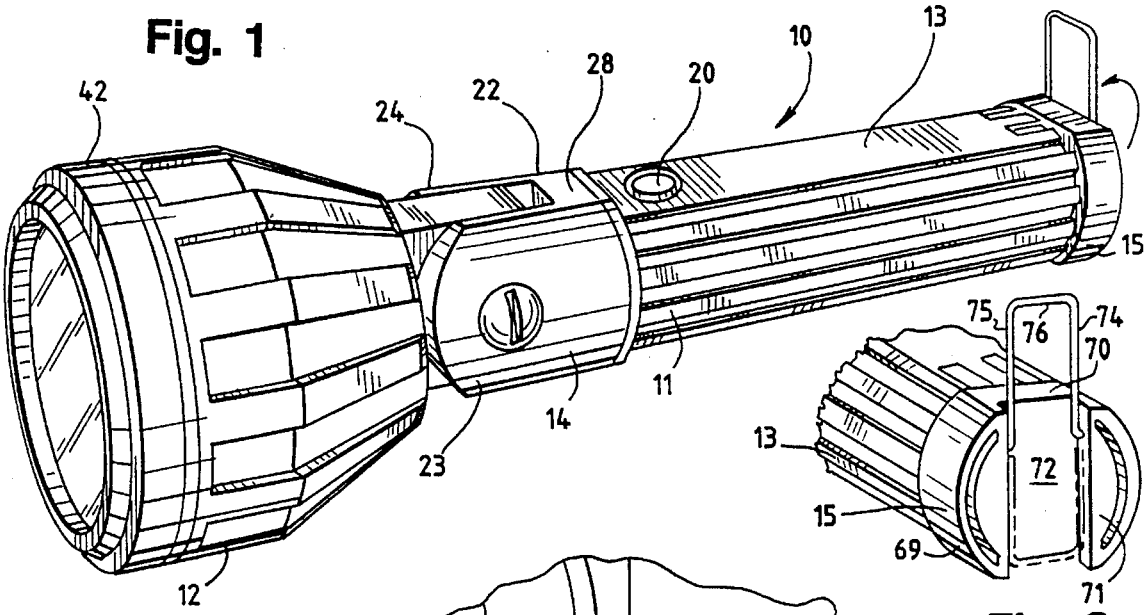
Fig. 2
Fig. 3
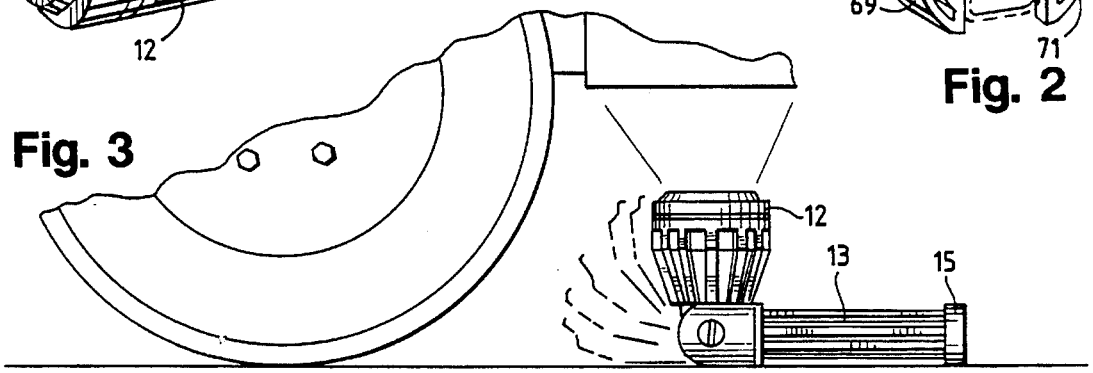
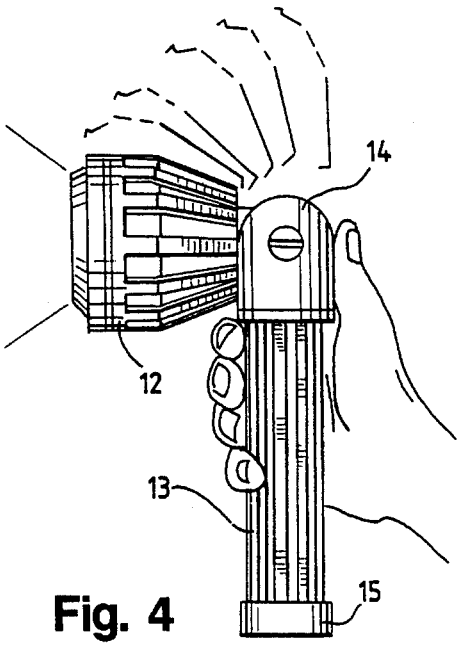
Fig. 4
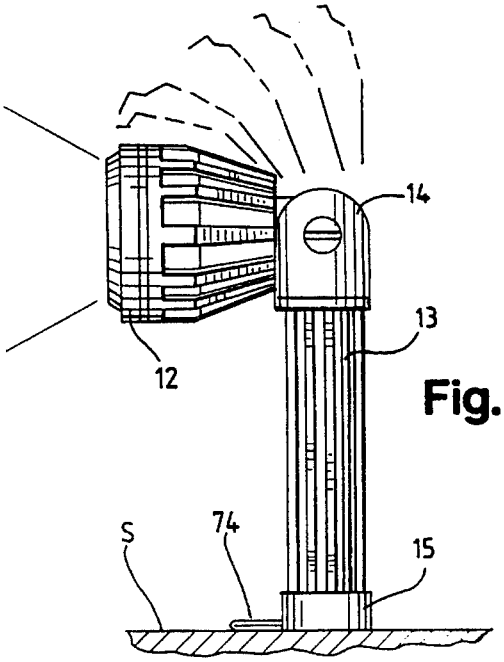
Fig. 5

FLASHLIGHT WITH PIVOTING HEAD

This invention relates to a flashlight, and, more particularly, to a flashlight with a pivoting head.

BACKGROUND

A flashlight generally includes a body or main housing which encloses one or more batteries and a head which supports a light source. The light beam from the light source generally extends parallel to the longitudinal axis of the body.

Some prior art flashlights have included a head which is movable relative to the body. The construction of such a flashlight is complicated by the necessity of maintaining an electrical connection between the light source and the battery as the head moves relative to the body. Another complication arises if the head is constructed to swivel throughout an arc of 180°.

SUMMARY OF THE INVENTION

The invention provides a swivel head flashlight which has a relatively uncomplicated structure and a sleek, attractive appearance. The head is pivotally mounted for 180° pivoting movement by a pivot pin which extends between two prongs of a bifurcated hinge housing. Detents on the head and on the pivot pin retain the head in a desired position. Electrical connection is maintained between the head and the battery case by wires which extend from the head, through the pivot pin, and through the hinge housing. The shape of the battery case and the hinge housing provides a stable support when the flashlight is supported horizontally, and a support clip on the bottom of the case can support the flashlight in a vertical position.

DESCRIPTION OF THE DRAWING

The invention will be explained in conjunction with the accompanying drawing, in which FIG. 1 is a perspective view of a flashlight which is formed in accordance with the invention;

FIG. 2 is a fragmentary perspective view of the bottom end of the flashlight;

FIG. 3 is a fragmentary view of the flashlight supported in a horizontal position;

FIG. 4 illustrates pivoting movement of the swivel head;

FIG. 5 shows the flashlight supported in a vertical position on a horizontal surface;

DESCRIPTION OF SPECIFIC EMBODIMENT

Figure 6:
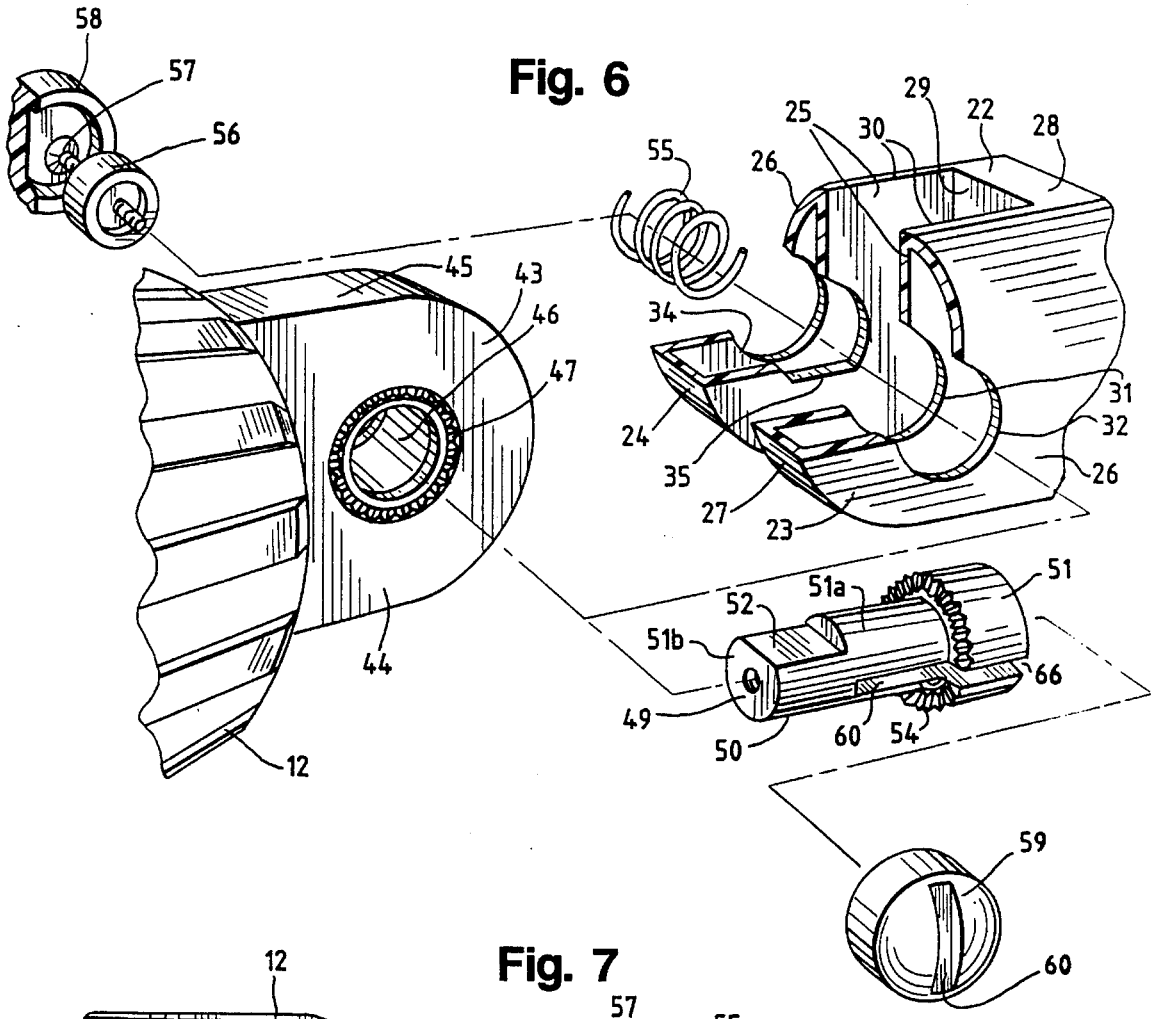
FIG. 6 is a fragmentary exploded view of the hinge assembly.

A flashlight 10 includes a body 11 and a head 12 which is pivotally connected to the body. The body 11 includes a tubular main housing 13, a bifurcated hinge housing 14 which is removably secured to the main housing, and an end cap 15. Batteries can be inserted into the housing 13 by removing the hinge housing 14 from the housing 13. The hinge housing 14 is advantageously removably secured to the housing 13 by tabs on the two housings which provide a twist-off connection.

Figure 8:
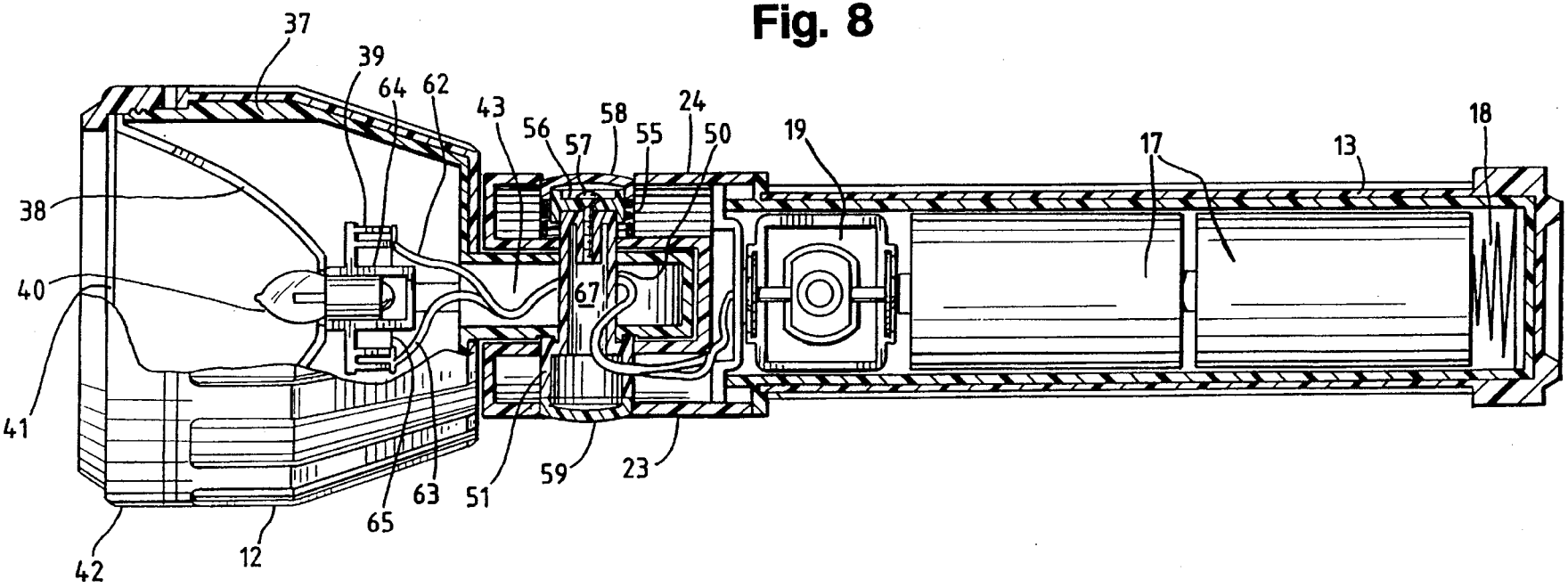
FIG. 8 is a longitudinal sectional view of the flashlight.

Referring to FIG. 8, the tubular main housing 13 is adapted to enclose a pair of dry cell batteries 17. A spring 18 on the end cap urges the batteries into electrical contact with a switch assembly 19. The switch is operated by a pushbutton 20 (FIG. 1) which extends through the main housing. The switch assembly can be conventional and is not part of this invention.

The bifurcated hinge housing 14 includes a base 22 and a pair of prongs 23 and 24. Referring to FIG. 6, each prong includes a flat inside wall 25, a curved outside wall 26, and a top wall 27. The base is formed by the curved side walls 26, a pair of flat walls 28, and a flat top wall 29. The curved outside wall 26 and the flat inside wall 25 of each prong merge along a pair of straight side edges 30 which extend upwardly from the flat walls 28.

The inside and outside walls of the prong 23 are provided with circular openings 31 and 32, and the inside and outside walls of the prong 24 are provided with openings 33 and 34. The outside opening 34 is circular, but the inside opening 33 includes a flat edge 35.

The head 12 includes a head housing 37, a reflector 38, and a bulb holder 39 which holds a lightbulb 40. A transparent lens 41 is held against the top of the reflector by a ring 42 which is screwed onto the head housing.

The head housing includes a pivot portion 43 which is sized to be positioned between the prongs of the hinge housing. The pivot portion includes a pair of flat side walls 44 and a U-shaped end wall 45. A circular opening 46 is provided in each of the walls 44. Referring to FIG. 6, one of the walls 44 includes a plurality of serrations, notches, or ratchet teeth 47 which extend around the opening 46.

Figure 7:
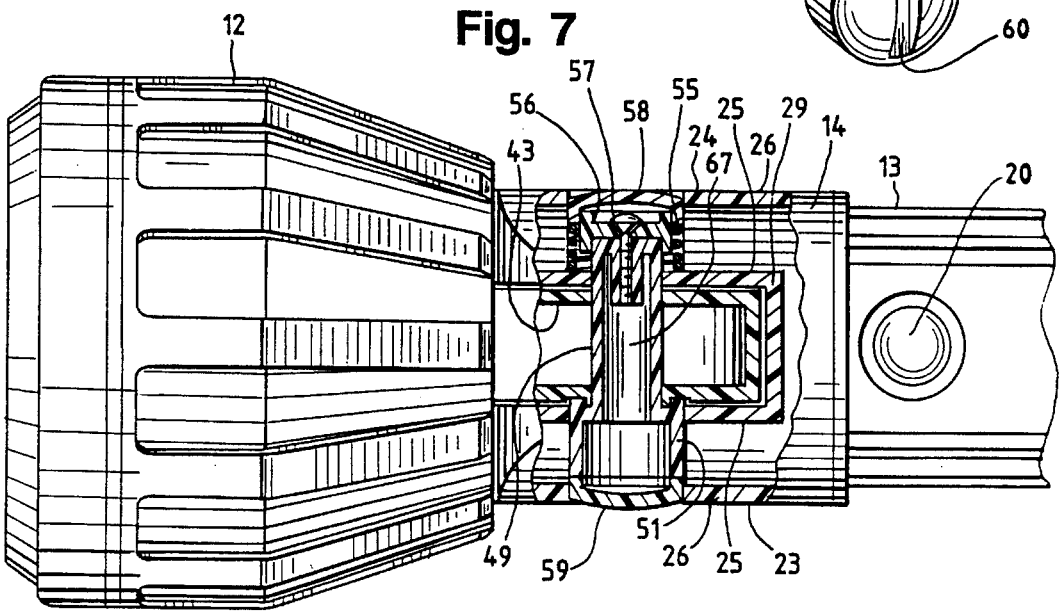
FIG. 7 is a fragmentary sectional view of the hinge assembly.

The pivot portion 43 of the head is pivotally retained between the prongs of the hinge housing 14 by a pivot pin 49 which extends through the openings 31–34 and 46. The pivot pin includes a shaft 50 and a radially enlarged head 51. The shaft includes a cylindrical central portion 51a which is positioned within the openings 46 in the walls 44 of the head (see FIGS. 7 and 8) and an end portion **51*b* which includes a flat 52. The end portion 51*b* is positioned within the non-circular opening 33 in the prong 24, and the flats 35 and 52** prevent rotation of the pivot pin within the prongs of the hinge housing.

The inside surface of the head 51 of the pivot pin includes serrations, notches or ratchet teeth 54 which are engageable with the serrations 47 in the head housing. The serrations are urged together by a spring 55 which is compressed between one of the flat walls 44 of the pivot portion of the head housing and a radially enlarged cover 56 which is attached to the end of the pivot pin by a screw 57.

An end cap 58 is threadedly engaged with the cover 56, and an end cap 59 is threadedly engaged with the head 51 of the pivot pin. Each of the caps is provided with a slot 60 to permit the cap to be unscrewed.

Referring to FIG. 8, the lightbulb 40 is electrically connected to the switch assembly 19 by a pair of wires 62 and 63. The wire 62 is connected to a bulb contact 64 which engages the side of the metal bulb cap, and the wire 63 is connected to a bulb contact 65 which engages the bottom terminal of the bulb. The wires extend into the pivot portion 43 of the head, through a slot 66 in the pivot pin 49 (see FIG. 6), through the central bore 67 of the hollow pivot pin, back through the slot 66, and into the prong 23 of the swivel housing. The wires are connected to the positive and negative terminals on one end of the switch assembly 19 and the batteries 17 are electrically connected to the positive and negative terminals on the other end of the switch assembly.

Referring to FIGS. 3–5, the head 12 can swivel through a 180° arc as indicated by the phantom outlines. The serrations 47 on the head and the serrations 54 on the pivot pin provide detents which maintain the head in any desired position throughout the 180° arc. The detent force which is provided by the spring 55 is sufficient to maintain the head in position against the weight of the head but can be readily overcome by manual force.

If desired, the pivot pin can be fixed relative to the head and can rotate relative to the hinge housing. In that case the serrations on the pivot pin would engage serrations on the hinge housing.

The electrical connection between the light bulb and the batteries does not interfere with the pivoting movement of the head. The wires 62 and 63 extend into the pivot pin 49, which is maintained stationary relative to the hinge housing 14, and the length of the wires between the bulb and the pivot pin is sufficient to permit the bulb to pivot about the pivot pin.

Referring to FIGS. 1 and 2, the end cap 15 of the main housing includes a pair of curved side walls 69, a pair of flat side walls 70, and a bottom surface 71. The bottom surface is provided with a central channel 72 which extends between the flat side walls 70. The central channel includes a pair of flat side walls 73, and a generally U-shaped support clip 74 is pivotally retained in openings in the walls 73. The support clip is made from spring wire and includes a pair of parallel legs 75 and a central bight portion 76. The ends of the legs 75 are bent outwardly and extend into the openings in the walls 73.

The position of the openings in the walls 73 and the length of the legs of the support clip are such that the clip can be retained in a storage position illustrated in phantom in FIG. 2 in which the clip is positioned inside of the outer periphery of the main housing. The bight portion 76 does not extend outwardly beyond the flat side wall 70.

When the support clip is pivoted to a support position illustrated in solid outline in FIG. 2, the legs of the clip engage the channel 72 and are prevented from pivoting beyond the position illustrated in FIG. 2. In the support position the clip extends beyond the main housing and can support the flashlight on a horizontal surface S (FIG. 5) when the longitudinal axis of the main housing extends vertically. The length of the support clip is sufficient to support the flashlight even when the head is pivoted to the FIG. 5 position in which the central axis of the light beam from the head extends perpendicularly to the axis of the main housing.

The flat surface 70 on the end cap 58, the flat surfaces 28 on the hinge housing 14, and the straight edges 30 of the prongs of the hinge housing can support the flashlight on a horizontal surface when the longitudinal axis of the main housing extends horizontally (FIG. 3). The head can be swivelled as indicated in FIG. 3 which the flashlight is supported horizontally. The flashlight can therefore illuminate, for example, the bottom of a vehicle as illustrated in FIG. 3.

The shape of the curved end 45 of the pivot portion 43 of the head is such that the end 45 does not project from the prongs 23 and 24 of the hinge housing as the head pivots. The main housing therefore remains flat on the horizontal surface in any of the positions of the head indicated in FIG. 3.

While in the foregoing specification, a detailed description of a specific embodiment of the invention was set forth for the purpose of illustration, it will be understood that many of the details herein given may be varied considerably by those skilled in the art without departing from the spirit and scope of the invention.

I claim:

1. A flashlight comprising an elongated main housing having a pair of ends, a hinge housing attached to one end of the main housing, a head housing pivotally secured to the hinge housing about an axis which extends generally transversely to the elongated main housing, a pivoting pin which extends from the hinge housing into the head housing along said axis, detent means on the pivot pin and detent means on one of said hinge housing and head housing for maintaining the head housing at a plurality of rotational positions relative to the hinge housing, a light holder mounted in the head housing, a wire extending from the light holder through the pivot pin and into the hinge housing, a battery contact in the main housing, and an electrical connection between the wire and the battery contact whereby the light holder remains electrically connected to the battery contact as the head housing pivots about the hinge housing.

2. The flashlight of claim 1 in which the pivot pin includes a longitudinally-extending slot and a central bore, and the wire extends from the light holder through the slot and the central bore of the pivot pin and into the hinge housing.

3. A flashlight comprising a body having a pair of ends and extending along a longitudinal axis, and a head pivotally secured to one end of the body and including a light source for directing a light beam along a beam axis, the body having a pair of spaced-apart hinge portions at said one end, the head having a hinge portion which extends between the spaced-apart hinge portions of the body, and a hinge pin which extends through the hinge portions of the body and the hinge portion of the head and which pivotally secures the head for pivoting movement through about 180° between a first position in which the beam axis is perpendicular to the body axis and the light beam is directed away from the body and a second opposite position in which the beam axis is perpendicular to the body axis and the light beam is directed away from the body, the flashlight including a support clip movably mounted on the other end of the body for movement between a storage position in which the support clip is positioned substantially within the periphery of the main housing and a support position in which the support clip extends transversely from the main housing for supporting the main housing on a horizontal surface.

4. The flashlight of claim 3 including detent means on the pivot pin and detent means on one of said hinge portions for maintaining the head at a plurality of rotational positions relative to the body.

5. The flashlight of claim 3 in which the pivot pin is fixed against rotation relative to the hinge portions of the body, each of the pivot pin and one said hinge portion including a plurality of cooperating detents for maintaining the head at a plurality of rotational positions relative to the body.

6. The flashlight of claim 3 in which the support clip is generally U-shaped and includes a pair of ends which are pivotally secured in the other end of the body.

7. A flashlight comprising a body having a pair of ends, and a head pivotally secured to one end of the body, the body having a pair of spaced-apart hinge portions at said one end, the head having a hinge portion which extends between the spaced-apart hinge portions of the body, and a hinge pin which extends through the hinge portions of the body and the hinge portion of the head and which pivotally secures the head for pivoting movement through about 180°, each of the hinge portions of the body including spaced-apart inner and outer walls, each of the inner and outer walls having an opening for the hinge pin, at least one of said openings being non-circular for preventing rotation of the hinge pin relative to the body.

8. The flashlight of claim 7 in which each of the hinge pin and the head housing includes a plurality of ratchet teeth which are engageable for maintaining the head at a plurality of rotational positions relative to the body.

9. The flashlight of claim 7 in which the hinge pin includes a central portion which is rotatably received within the hinge portion of the head, a first radially enlarged end portion which is positioned in one of the hinge portions of the body and a second radially enlarged end portion which is positioned in the other of the hinge portions of the body, the first end portion of the pivot pin and the hinge portion of the head including detent means for maintaining the head at a plurality of rotational positions relative to the body, and a spring between the inner wall of the other hinge portion of the body and the second end portion of the pivot pin for resiliently urging the detent means on the first end portion of the pivot pin toward the detent means on the hinge portion of the head.

10. The flashlight of claim 7 including a light holder mounted in the head, a wire extending from the light holder through the pivot pin and into the space between the inner and outer walls of one of the hinge portions of the body, a battery contact in the body, and an electrical connection between the wire and the battery contact whereby the light holder remains electrically connected to the battery contact relative to the body.

11. The flashlight of claim 10 in which the pivot pin includes a longitudinally-extending slot and a central bore, and the wire extends from the light holder through the slot and the central bore of the pivot pin and into the hinge housing.

12. A flashlight comprising a body having a pair of ends and extending along a longitudinal axis, and a head pivotally secured to one end of the body and including a light source for directing a light beam along a beam axis, the body having a pair of spaced-apart hinge portions at said one end, the head having a hinge portion which extends between the spaced-apart hinge portions of the body, and a hinge pin which extends through the hinge portions of the body and the hinge portion of the head and which pivotally secures the head for pivoting movement between a first position in which the beam axis and the body axis are generally parallel and a second position in which the beam axis and the body axis are generally perpendicular, each of the hinge portions of the body including front and rear surfaces which extend generally parallel to the body axis, the hinge portion of the head including front and rear surfaces which remain inside of the front and rear surfaces of the hinge portions of the body when the head pivots between the first and second positions.

13. The flashlight of 12 in which the front and rear surfaces of the hinge portions of the body are adapted to support the flashlight on a horizontal surface with the body axis extending generally horizontally when the head is positioned in either the first or second positions or in any intermediate position.

14. The flashlight of claim 12 in which the body includes a longitudinally extending flat surface for supporting the flashlight on a horizontal surface with the body axis extending substantially horizontally when the head is positioned in either the first or second positions or in any intermediate position.

15. The flashlight of claim 12 including a support clip movably mounted on the other end of the body for movement between a storage position in which the support clip is positioned substantially with the periphery of the main housing and a support position in which the support clip extends transversely from the main housing for supporting the main housing on a horizontal surface when the longitudinal dimension of the main housing extends vertically and the head is in the second position.

16. A flashlight comprising:

an elongated main housing having a pair of ends, a hinge housing attached to one end of the main housing, a head housing pivotally secured to the hinge housing about an axis which extends generally transversely to the elongated main housing, a pivot pin which extends from the hinge housing into the head housing along said axis, a light holder mounted in the head housing, a wire extending from the light holder through the pivot pin and into the hinge housing, a battery contact in the main housing, and an electrical connection between the wire and the battery contact whereby the light holder remains electrically connected to the battery contact as the head housing pivots about the hinge housing, the pivot pin including a longitudinally-extending slot and a central bore, and the wire extending from the light holder through the slot and the central bore of the pivot pin and into the hinge housing.

* * * * *